United States Patent [19]

Chapple

[11] Patent Number: 4,881,123

[45] Date of Patent: Nov. 14, 1989

[54] VOICE OVERRIDE AND AMPLITUDE CONTROL CIRCUIT

[76] Inventor: James H. Chapple, 415 Tyler Pl., Apt. L, Salinas, Calif. 93906

[21] Appl. No.: 164,886

[22] Filed: Mar. 7, 1988

[51] Int. Cl.[4] ..... H04R 27/00

[52] U.S. Cl. ..... 381/104; 381/82; 381/110

[58] Field of Search ..... 381/77, 80, 81, 82, 381/85, 104, 109, 110

[56] References Cited

U.S. PATENT DOCUMENTS

| | | | |
|---|---|---|---|
| 3,005,873 | 10/1961 | Janowsky | 381/82 |
| 3,493,681 | 2/1970 | Richards | 381/81 |
| 3,518,375 | 6/1970 | Hawkins | 381/110 |
| 3,989,908 | 11/1976 | Budrys | 381/82 |
| 3,992,584 | 11/1976 | Dugan | 381/82 |
| 4,035,589 | 7/1977 | Parke | 381/82 |
| 4,404,429 | 9/1983 | Griffis | 381/109 |
| 4,675,905 | 6/1987 | Flora | 381/81 |

*Primary Examiner*—Tommy P. Chin

*Attorney, Agent, or Firm*—Schroeder, Davis & Orliss

[57] ABSTRACT

An audio system having a voice override and voice amplification control circuitry is provided. The system provides high quality music to a listener through a set of headphones and includes a microphone and a foot operated switch to allow a user to override the music signal to communicate with the listener. The foot switch initiates a ramp voltage signal generator which gradually attenuates the normal music signal to a predetermined level and gradually increases the level of the voice signal and mixes it with the music signal. When the voice signal terminates, the music gradually returns to its normal level when the foot switch is deactivated resetting the ramp voltage signal generator.

15 Claims, 3 Drawing Sheets

VOICE OVERRIDE AND AMPLITUDE CONTROL CIRCUIT

BACKGROUND OF THE INVENTION

The present invention relates generally to a voice override and amplitude control circuit for an audio entertainment system, and more particularly to a voice override and amplitude control circuit which gradually suppresses a normal music signal to allow the normal music signal to be overridden by a voice signal and which gradually returns the music signal to its full strength at the conclusion of the voice signal.

In the offices of doctors and dentists and the like, it is common practice to provide music for the enjoyment of the patients awaiting their appointments and others in the waiting rooms and for the relaxation of patients while undergoing treatment as in a dentist chair, for example. It is further common practice to provide a public address system for calling patients or making other announcements to those in the waiting rooms or for providing instructions or the like to patients undergoing treatment. The communication system utilized may be either two separate systems, one for the music and one to serve as the public address system or a single system may be used for both the music and voice communications. One or more speakers are utilized in larger, more public areas, such as a doctor's waiting room, while individual systems such as headphones and the like are provided for patients undergoing treatment.

Typically, such a system is set up to provide music for the majority of the time while allowing the music to be suppressed when it is desired transmit a voice signal to effect communication with a patient or others. It is known in the prior art to provide means, such as manual switches or automatic muting circuitry, to allow the music signal to be overridden by a voice signal. However the transition from music to voice, and back again, is abrupt. Further, most systems suppress the music completely when transmitting a voice signal. Under certain conditions, it is highly desireable that a patient not make sudden movements while undergoing treatment, such as a patient in a dentist chair. When a dentist interrupts the music to provide instructions or speak to a patient under treatment, the abrupt transition from music to voice may startle a relaxed patient thereby causing the patient to move suddenly and disrupt the treatment or even cause injury to the patient.

U.S. Pat. No. 3,518,375 entitled "Voice Override Circuit" issued on June 30, 1970 to William R. Hawkins discloses an audio system in which a voice signal from a microphone automatically suppresses the normal signal which resumes after the voice signal terminates. The normal music signal is applied across a voltage divider circuit that comprises a first resistor, the collector and emitter of a transistor and an emitter load resistor. When the transistor is off, i.e., non-conductive, its impedance is very high compared to the first resistor and substantially the full signal strength of the music signal is applied to an audio amplifier and speaker system. When a microphone signal of sufficient strength is present, the transistor switches on and the music signal input to the amplifier is reduced by an amount dependent upon the ratio of the values of the first resistor and the emitter load resistor. At the same time, a capacitor is quickly charged and maintains the transistor in a conductive state. When the microphone signal terminates, the capacitor discharges and the transistor switches off when the capacitor potential drops below the required transistor base bias voltage and the full, normal music signal is again applied to the amplifier. The transistor acts as a switch, abruptly suppressing the normal music signal and transmitting the full strength voice signal to the speaker system. Similarly, when the voice signal terminates, after a short delay, the music signal is abruptly returned to its full strength.

Primarily, it is an object of the present invention to provide an audio system providing a normal music signal which may be gradually overridden by a voice signal, the music signal being gradually attenuated a predetermined amount and the voice signal strength gradually increased to a level determined by a volume setting and the music signal gradually returning to its normal level upon termination of the voice signal.

SUMMARY OF THE INVENTION

In an audio system according to the principles of the present invention, a normal music signal provided from a separate source is amplified and coupled to a set of speakers or to headphones for individual patient utilization. The audio system includes a microphone and associated pre-amplifier to allow a dentist or doctor to communicate with a patient undergoing treatment. The audio system further includes means for muting the microphone when it is not in use and for gradually attenuating the normal music signal and mixing the voice signal with the attenuated music signal when the microphone is being utilized, gradually increasing the combined music and voice signal strength to a predetermined level which is set by a patient volume control. A switching means controlled by the dentist or doctor, such as a manually operated foot switch, controls the muting means. Upon actuation of the switch means, a ramp signal having a linear slope over a preset time interval is initiated. The ramp signal is coupled to the preamplifier microphone and the audio amplifiers to control the voice signal level and the mixing of the voice signal with the music signal. When the switching means is deactivated, the ramp signal reverses and allows the signal strength of the music signal to gradually increase to its normal level as determined by the patient adjusted volume control.

DETAILED DESCRIPTION OF THE PREFERRED EMBODIMENT

Figure 1:
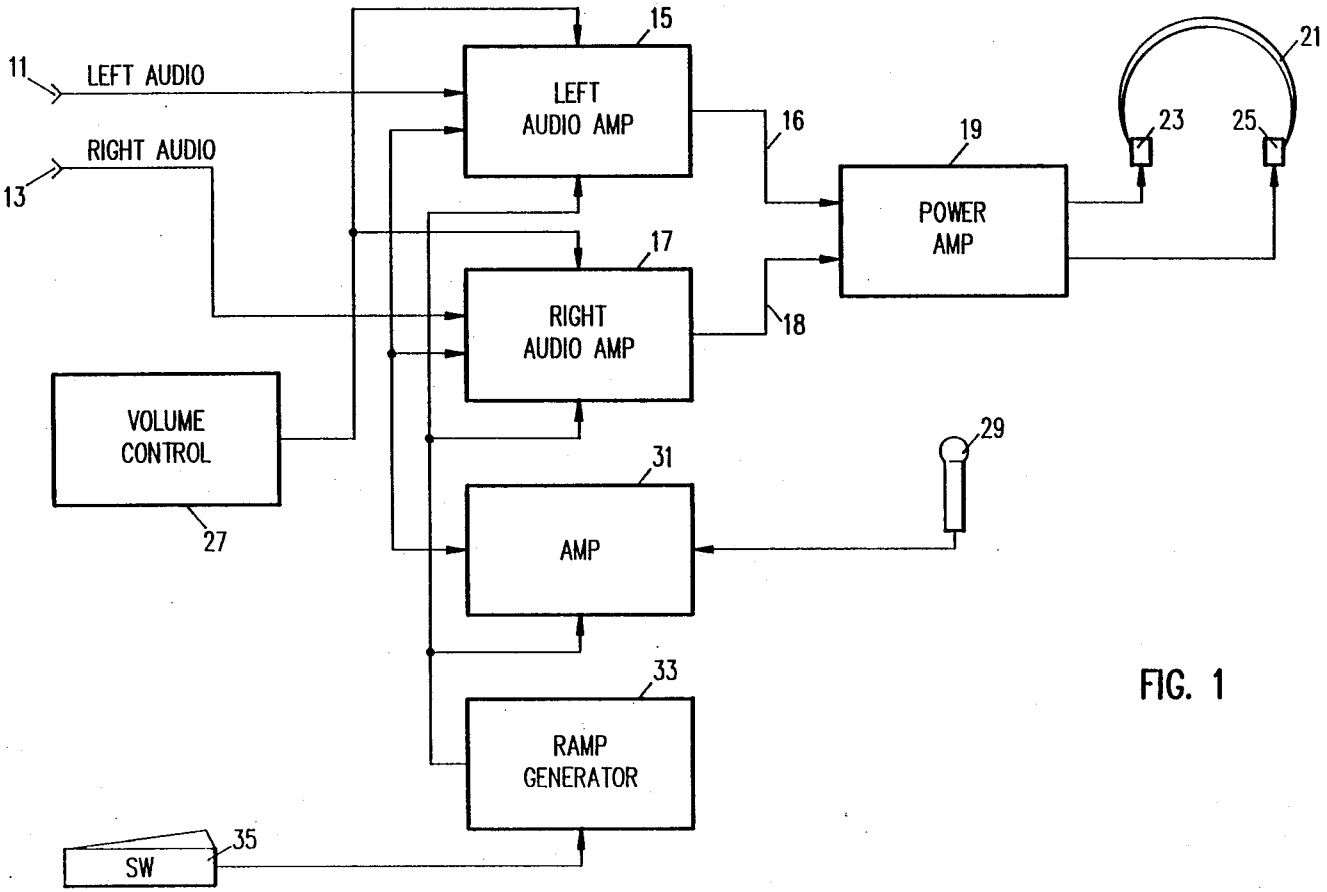
FIG. 1 is a functional block diagram of a voice override and amplitude control circuit for an audio system according to the principles of the present invention.

Referring now to FIG. 1, a block diagram of a voice override and amplitude control circuit for use with music and entertainment systems is shown. A separate normal music source (not shown), such as a commercial broadcast station or a high quality reproduction system, a compact disc player, for example, provides a left audio signal and a right audio signal at the left audio input 11 and the right audio input 13 to be coupled to a left audio amplifier 15 and a right audio amplifier 17, respectively. The left and right audio signals are then coupled to a speaker system, such as headphone set 21 having a left speaker 23 and a right speaker 25. A power amplifier 19 provides sufficient power in each audio channel to drive the speakers 23 and 25. A manually adjusted volume control 27 adjusts the amplification factor of each audio amplifier 15 and 17 to provide a desired music volume for the listener. A microphone 29 is provided to allow a user to communicate with the listener by temporarily overriding and mixing the normal music signal with a voice signal. Audio amplifier 31 serves as a preamplifier for a voice signal input from microphone 29 and couples the amplified voice signal to the left and right audio amplifiers 15, 17 to be mixed with the normal music signal at the input to the audio amplifiers. The mixed or composite audio signal for the left and right audio channel is coupled on lines 16 and 18 to the power amplifier 19 and to the headphone speakers 23 and 25, respectively. Since the volume control 27 adjusts the gain factor of the left and right audio amplifiers 15, 17, the composite audio signal in each channel is set at the desired level.

A ramp generator 23 generates a ramp voltage signal having a linearly increasing slope over a predetermined time period to provide a gradual, linear transition form the normal music signal to the composite, voice-music mixed audio signal. The ramp output of the ramp generator 23 is coupled to the input circuitry of the left and right audio amplifiers 15, 17 to gradually decrease or suppress the amount of the left and right audio signals input to the audio amplifiers 15, 17. Simultaneously, the ramp output is also coupled to the microphone preamplifier 31 to control the amplification factor of the amplifier 31 to gradually increase the signal strength of the voice signal to be input to the left and right audio amplifiers 15, 17 and be mixed and amplified with the attenuated music signal. The ramp generator is controlled by switch 35 which may be a foot operated switch. When the switch 25 is off or deactivated, the ramp generator 33 output is at a minimum level and the output of the microphone preamplifier 31 is also at a minimum level effectively muting the microphone 29. Similarly, the normal music signal input to the left and right audio amplifiers 15, 17 is at its full signal strength. When the switch 35 is activated, the ramp generator 33 is triggered and its output linearly increases from a minimum voltage level to a maximum voltage level over a preset time period. When the switch 35 is deactivated, the ramp generator 33 output linearly decreases from its maximum voltage level to a minimum output to provide a linear transition from the composite, voice overridden audio signal to the normal music signal.

Figure 2A:
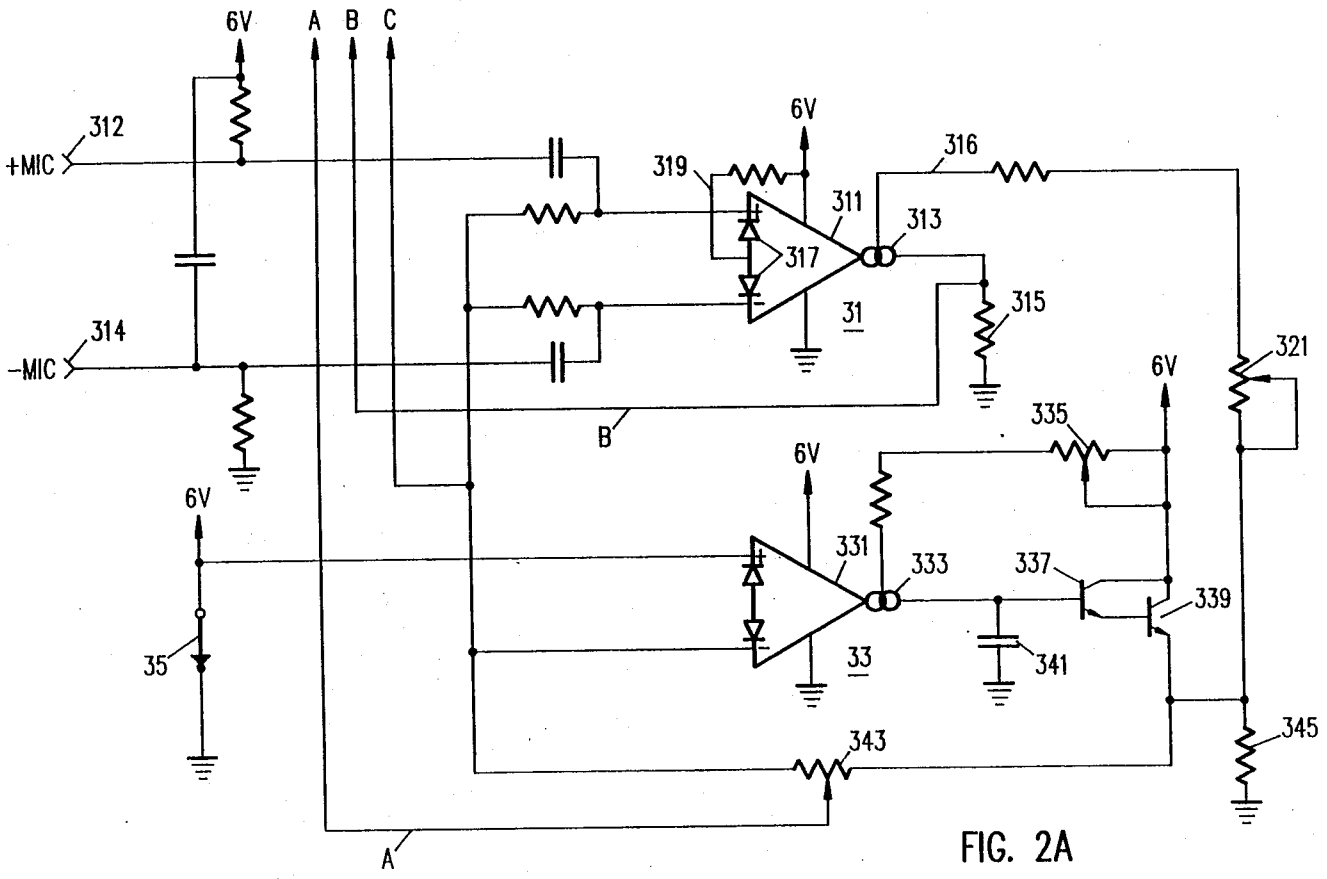
FIGS. 2 and 2B are a schematic diagram of the voice override and amplitude control circuit of FIG. 1.
Figure 2B:
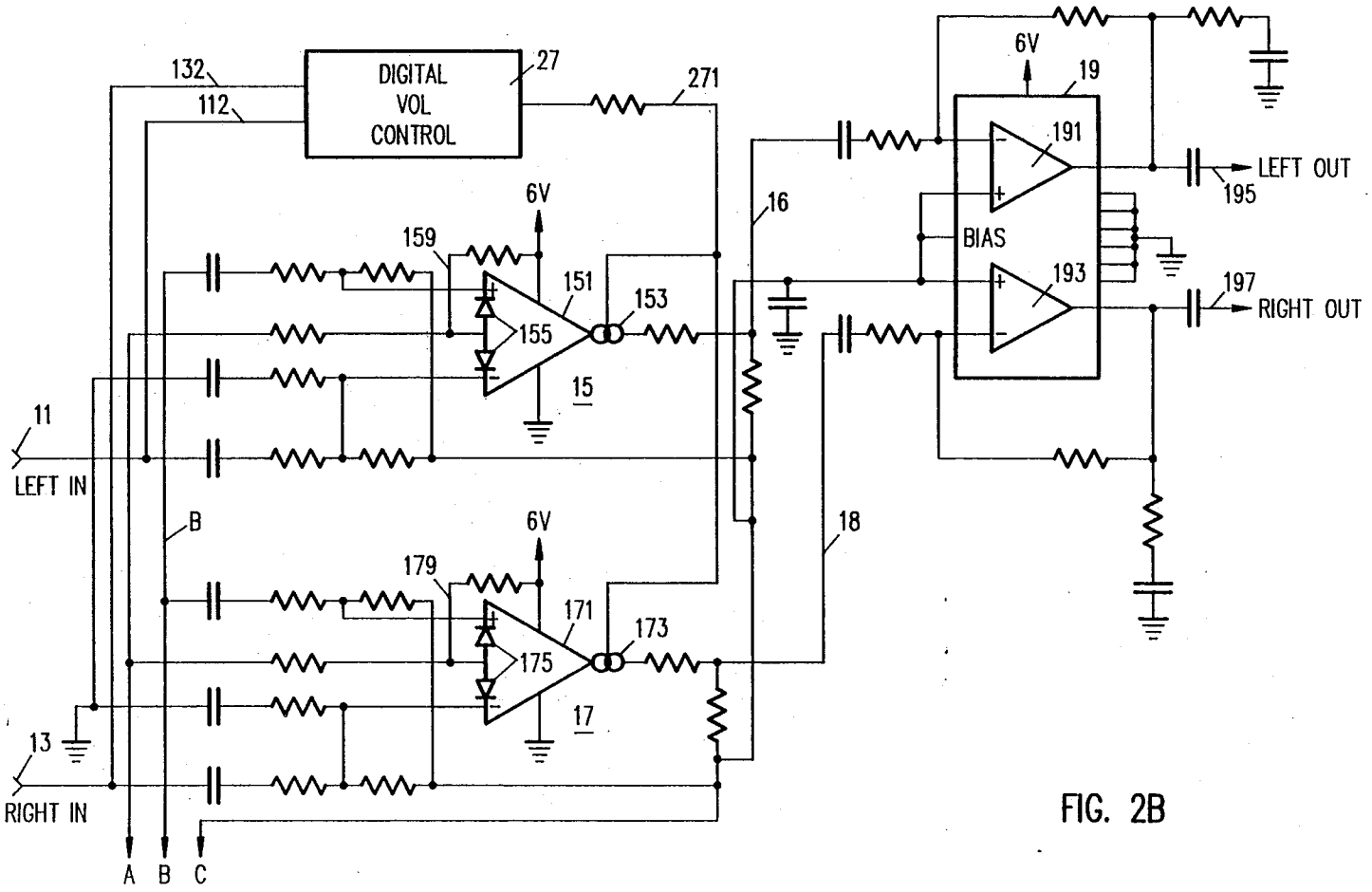

Referring now also to FIGS. 2A and 2B, schematic diagram of the preferred embodiment is shown. The left and right audio amplifiers 15, 17 are substantially identical circuits comprising operational amplifiers 151 and 171, respectively, having controllable current sources 153 and 173, respectively, coupled to the operational amplifier output which effectively control the output impedance of the amplifiers (LM13600 transconductance amplifiers manufactured by National Semiconductor are suitable for this purpose). The normal music signal is coupled to the negative input of each operational amplifier 151, 171 for the left and right channel, respectively. The microphone voice signal is coupled from the microphone preamplifier 31 on line B to the positive input of each operational amplifier 151, 171 for the left and right channel, respectively. Normal bias for the amplifiers is provided on line 159, 179 coupled to the junction between the cathodes of the "back-to-back" connected diodes 155, 175, respectively. Under normal, no-voice signal, operating conditions there is a minimum signal level at the positive inputs and the bias is set to input the full audio signal input for the left and right channels at audio inputs 11 and 13, respectively.

The microphone preamplifier 31 comprises essentially identical circuitry as the left and right audio amplifiers 15, 17 and comprises an operational amplifier 311 and controllable current source 313 with load resistor 315. Similarly, the operational amplifier 311 is biased by line 319 coupled to the junction between diodes 317. A differential voice signal is input at microphone inputs 312 and 314, with the positive voice signal coupled to the amplifier positive input and the negative voice signal coupled to the amplifier negative input. Under normal, no-voice signal, conditions the control voltage on line 316 to the controllable current source 313 is minimum and the output of the amplifier 31 on line B is zero or minimum.

The ramp generator 33 comprises an operational amplifier 331 having a controlled current source 333 at its output (LM13600 transconductance amplifier manufactured by National Semiconductor is suitable for both the ramp generator 33 and the microphone amplifier 31). The output of current source 333 is coupled to the base of transistor 337 and one plate of ramp capacitor 341 connected between the current source 333 output and ground. Transistors 337 and 339 are connected as a darlington amplifier with the emitter of transistor 339 coupled to ground through resistor 345. Switch 35 is normally closed coupling the positive input of operational amplifier 331 to ground and keeping the output of current source 333 at zero or a minimum value, thus maintaining the darlington amplifier in a cutoff or non-conducting state. When the switch 35 is activated, i.e., opened, a positive voltage level is applied to the positive input of operational amplifier 331 causing an output from current source 333 which charges ramp capacitor 341. As the ramp capacitor 341 charges, an increasing, positive voltage is presented to the base of transistor 337 which causes transistor 339 to start conducting through resistor 345 to ground. The current through transistor 339 increases linearly as the charge on ramp capacitor 341 increases thereby producing a linearly increasing voltage drop across resistor 345 which reaches a maximum value when transistor 339 reaches its saturation current. The voltage required at the base of transistor 339 to saturate the darlington pair is set such that only the initial, linear portion of the ramp capacitor charging curve is utilized to control the current through the darlington pair. Once the darlington current reaches saturation, the current remains steady at the saturation current until switch 35 is deactivated, i.e., closed thus grounding the positive input terminal, cutting off the operational amplifier 331 and reducing the output of the current source 333 to zero (or a minimum value). With a zero output from the current amplifier 333, the ramp capacitor 341 discharges through the darlington pair and resistor 345 to ground. As the ramp capacitor voltages drops, the darlington current linear decreases until cutoff voltage is reached. The charge rate of the ramp capacitor 341 is determined by the value of the adjustable pan rate resistor 335 which sets the output impedance of the operational amplifier 331 to control the current output of current source 333. The discharge rate of the ramp capacitor 341 is determined by the impedances of transistors 337 and 339 and the value of resistor 345.

The ramp voltage signal across resistor 345 is coupled to the microphone amplifier 31 on line 316 and serves as the control voltage for the output current source 313 effectively controlling the gain of the amplifier 31. As the ramp voltage increases, the output of current source 313 increases and is coupled on line B to the positive inputs at the left and right audio amplifiers 151 and 171, respectively. Adjustable resistor 321 serves as an internal volume control for the microphone voice signal output by the microphone preamplifier 31. The ramp voltage across resistor 345 is also applied to the bias circuitry for left and right audio amplifiers 151 and 171 on line A. The normal bias voltage at the junction between diodes 155 and 175 for the left and right audio amplifiers 151 and 171, respectively, is developed across a voltage divider network including the resistors in lines 159 and 179, respectively, through line A, adjustable muting resistor 343 and resistor 345. As the ramp voltage across resistor increases or decreases, it is coupled on line A to the bias point between diodes 155 and 175, respectively to effectively increase or decrease the bias voltage on operational amplifiers 151 and 171. When the bias is increased, it effectively reduces the amount of the normal music audio signal input to the negative input terminals and increases the amount of the microphone voice signal input to the positive input terminals of the operational amplifiers 151 and 171 thereby attenuating the normal music signal to a predetermined level and allowing the voice signal to override the music signal. The amount of attenuation or muting of the normal music signal is set by resistor 343. Typically, resistor 343 is adjusted to provide a mixture of both music (at a low level) and voice (at a higher level) to provide effective communication without complete elimination of the music. Conversely, when the ramp voltage across resistor 345 decreases, the bias voltage on the operational amplifiers 151 and 171 is reduced to its normal value, reducing the voice signal input coupled to the positive terminals to zero (or a minimum value) and allowing the normal music signal coupled to the negative input terminals to return to its full signal strength. Simultaneously, as the ramp voltage across resistor 345 decreases, the output of the microphone preamplifier 31 is reduced to zero (or a minimum value). When the ramp generator is cut off, i.e., switch 35 has grounded the positive terminal of operational amplifier 331, there is minimum voltage developed across resistor 345 and the output of the microphone preamplifier 31 is minimum regardless of whether or not a microphone voice signal is present on input lines 312 and 314.

In the preferred embodiment, switch 35 is a manually operated, preferable foot-operated switch. However, the invention is not limited to a manually operated switch as various, well-known methods would equally serve, such as a voice-activated switching circuit initiated by the user speaking into the microphone.

The output of the left and right audio amplifiers is coupled on lines 16 and 18 to power amplifier 19 to provide sufficient audio power on output lines 195 and 197 to drive the left and right channel speakers (not shown), respectively. Power amplifier 19 comprises a dual-channel amplifier connected in a known manner (a dual LM1877 audio power amplifier manufactured by National Semiconductor is suitable for this purpose). The amplitude or volume of the audio signal output on lines 16 and 18 is controlled by digital volume control circuit 27. Digital volume control may be accomplished by any of several well-known methods and will not be further explained herein. The left and right channel normal music signal is input to the digital volume control circuitry 27 on lines 112 and 132, respectively, to provide a balance volume control signal on line 271 to the left and right audio amplifiers 15 and 17, respectively. The volume control signal is coupled to current sources 153 and 173 to control the output impedance of the operational amplifiers 151 and 171 thereby effectively controlling the gain of the left and right audio amplifiers 15 and 17, respectively. Since the microphone voice signal and the music signal are mixed at the input to the operational amplifier, one volume control, operated by the listener, controls the volume of the mixed, voice-music output and it is not necessary to make separate adjustments during operation of the system.

I claim:

1. In an audio system, electronic circuitry for overriding a normal audio signal with a voice signal, said electronic circuitry comprising:

at least one audio channel having at least one stage of amplification, said amplification stage having a first input for inputting said normal audio signal and a second input for inputting said voice signal, said amplification stage including bias means for setting the relative input levels of said normal audio signal and said voice signal;

amplifier means having an output, said output coupled to said second input, for amplifying said voice signal and coupling said voice signal to said second input, said amplifier means including means responsive to a control signal for controlling the amplitude of said voice signal; and control means coupled to said amplification stage and to said amplifier means and to said first and second inputs of said amplification stage for providing said control signal, said control signal applied to a bias input of said amplification stage, said bias means responsive to said control signal for linearly decreasing the level of said normal audio signal input to said amplification stage to a predetermined level of said normal audio signal and for linearly increasing the level of said voice signal input to said amplification stage from a minimum to a maximum level, said control means including adjusting means to adjust said predetermined level of said normal audio signal.

2. Electronic circuitry as in claim 1 wherein said control means is selectively operable to provide a first output signal from said amplification stage comprising said voice signal and a reduced level of said normal audio signal when said voice signal is input to said amplifier means and to provide a second output signal from said amplification stage comprising said normal audio signal when said voice signal is not input to said amplifier means, said bias means responsive to said control signal for providing a gradual, linear transition between said first output signal and said second output signal over a predetermined time period whenever said voice signal input to said amplifier means is initiated or terminated.

3. Electronic circuitry as in claim 2 wherein said control means includes switch means for initiating said control signal when said switch means is activated and terminating said control signal when said switch means is deactivated.

4. Electronic circuitry as in claim 3 wherein said switch means comprises a manually operated switch.

5. Electronic circuitry as in claim 2 wherein said amplification stage includes volume control means responsive to a volume control signal for controlling the gain factor of said amplification stage.

6. Electronic circuitry as in claim 5 wherein the level of said volume control signal is manually set by an audio system user, said volume control means responsive to said volume control signal to control the level of said first and second output signals.

7. Electronic circuitry as in claim 2 wherein the level of said first output signal is the same level as that of said second output signal.

8. Electronic circuitry as in claim 1 wherein said predetermined level of said normal audio signal is greater than zero.

9. In an audio system, electronic circuitry for overriding a normal music signal with a voice signal and providing a composite signal comprising said voice signal and a reduced level of said normal music signal, said electronic circuitry comprising:

at least one audio channel having at least one amplification stage, said amplification stage having a first input for inputting a normal music signal and a second input for inputting a voice signal, said amplification stage further including bias means for setting the relative input levels of said normal music signal and said voice signal;

voice amplifier means having an output, said output coupled to said second input, for amplifying said voice signal and coupling said voice signal to said second input, said voice amplifier means including means responsive to a control signal for controlling the gain of said voice amplifier means thereby controlling the amplitude of said voice signal output by said voice amplifier means;

ramp voltage generator means coupled to said amplification stage and to said voice amplifier means for generating a ramp voltage signal, said ramp voltage signal comprising said control signal, said ramp voltage signal applied to a bias signal input of said amplification stage, said ramp voltage signal linearly increasing from a minimum level to a maximum level over a predetermined time period when said ramp voltage generator means is initiated, said ramp voltage signal linearly decreasing from said maximum level to a minimum level when said ramp voltage generator means is reset, said bias means responsive to said linearly increasing ramp voltage signal for linearly attenuating said normal music signal input to said amplification stage to a predetermined level of said normal music signal and linearly increasing the level of said voice signal input to said amplification stage form a minimum level to a maximum level over said predetermined time period to provide said composite signal, said bias means responsive to said linearly decreasing ramp voltage signal for linearly increasing the level of said normal music signal input to said amplification stage from said predetermined level to a maximum level and for linearly decreasing the level of said voice signal input to said amplification stage from said maximum level to said minimum level over said predetermined time period; and switch means coupled to said ramp voltage generator means for initiating said ramp voltage generator means for initiating said ramp voltage generator means when said switch means is activated and for resetting said ramp voltage generator means when said switch means is deactivated.

10. Electronic circuitry as in claim 1 wherein said switch means comprised a manually operated switch.

11. Electronic circuitry as in claim 10 wherein said manually operated switch comprises a foot operated switch.

12. Electronic circuitry as in claim 9 further comprising at least one speaker coupled to said amplification stage and a power amplifier interconnected between said amplification stage and said speaker.

13. Electronic circuitry as in claim 9 wherein said amplification stage include volume control means responsive to a volume control signal for controlling the gain factor of said amplification stage.

14. Electronic circuitry as in claim 13 wherein the level of said volume control signal is adjustable by an audio system user, said volume control means responsive to said volume control signal to set the output level of said composite signal and of said normal music signal when no voice signal is present.

15. Electronic circuitry as in claim 9 wherein said ramp voltage generator means includes adjusting means for adjusting said predetermined level of said normal music signal.

* * * * *